US006990905B1

(12) United States Patent
Manole et al.

(10) Patent No.: US 6,990,905 B1
(45) Date of Patent: Jan. 31, 2006

(54) MARKER PROJECTILE

(75) Inventors: Leon R. Manole, Great Meadows, NJ (US); Stewart Gilman, Budd Lake, NJ (US); Robert Nodarse, Stillwater, NJ (US); Andrew Perich, Vernon, NJ (US); Floyd Ribe, Succasunna, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 167 days.

(21) Appl. No.: 10/605,702

(22) Filed: Oct. 21, 2003

Related U.S. Application Data

(60) Provisional application No. 60/481,041, filed on Jun. 30, 2003.

(51) Int. Cl.
*F42B 12/38* (2006.01)

(52) U.S. Cl. ..... 102/513; 362/34

(58) Field of Classification Search ..... 102/513, 102/502, 529, 395, 458, 498
See application file for complete search history.

(56) References Cited

U.S. PATENT DOCUMENTS 3,515,070 A * 6/1970 Cutler et al. ..... 102/513
3,736,874 A * 6/1973 Gerber ..... 102/382
3,774,022 A * 11/1973 Dubrow et al. ..... 362/34
3,940,605 A * 2/1976 Gerber ..... 362/34
4,553,481 A * 11/1985 Ricci ..... 102/458
4,706,568 A * 11/1987 Lundwall et al. ..... 102/513
4,841,866 A * 6/1989 Miesner ..... 102/458
5,018,450 A * 5/1991 Smith ..... 102/513
5,027,710 A * 7/1991 Wittmann et al. ..... 102/513
5,546,863 A * 8/1996 Joslyn ..... 102/504
6,497,181 B1 * 12/2002 Manole et al. ..... 102/513
6,615,739 B2 * 9/2003 Gibson et al. ..... 102/513
6,931,993 B1 * 8/2005 Manole et al. ..... 102/458

* cited by examiner

*Primary Examiner*—Michael J. Carone
*Assistant Examiner*—James S. Bergin
(74) *Attorney, Agent, or Firm*—Michael C. Sachs; John F. Moran

(57) ABSTRACT

A non-lethal marker projectile that provides site identification capability of a target upon impact includes a rear base made of plastic and a front end extending longitudinally from the rear base. The front end defines a space therein and includes an outer surface having a rear portion attached to the base and a nose portion. The front end also includes a breakable container system located in the space which contains separated chemiluminescent reagents which when mixed produce light. The front end further includes a foam filler which surrounds the breakable container system and which fills the space. The container system breaks on a setback impact that is exerted during firing and initial launch, causing the chemiluminescent reagents to mix and be absorbed into the foam filler, such that upon impact of the projectile with the target, the foam filler marks the target with the mixed chemiluminescent reagents diffused therein.

5 Claims, 3 Drawing Sheets

MARKER PROJECTILE

CROSS REFERENCE TO RELATED APPLICATIONS

This application claims benefit under 35 U.S.C. 119(e) of provisional application 60/481,041, filed 30 Jun. 2003, the entire file wrapper contents of which provisional application are herein incorporated by reference as though fully set forth at length.

FEDERAL RESEARCH STATEMENT

The inventions described herein may be manufactured, used and licensed by or for the U.S. Government for U.S. Government purposes.

BACKGROUND OF INVENTION

The current US military 40 mm M781 marker projectile is fired from the M203 grenade launcher which is attached to the M16 rifle. This projectile is comprised of a plastic windshield, which contains a florescent powder, and a zinc body that attaches to the windshield.

The basic function of the M781 is as a training round that marks the target with a fluorescent powder. If the M781 projectile hits a person or a light target, it may be lethal to the person and may severely damage the light target. The M781 fluorescent mark on the target can only be seen during the day. In addition, the M781 does not have a tracer that allows an observer to see the flight of the projectile to the target. The maximum gun launched service velocity of the M781 projectile is approximately 250 ft/sec and has a range of approximately 400 meters.

The current US military XM1062 marker munition (as disclosed in U.S. Pat. No. 6,497,181, which is herein incorporated by reference) provides a trace of the projectile travel and a mark of the target with chemiluminescent materials that glow and therefore can be seen at night and in low light settings. The XM1062 projectile is comprised of a plastic windshield and an optional rear plastic windshield. The windshields are attached to a zinc body. In practice, one or more glass or plastic vials, some containing a liquid peroxide and some containing a oxalate liquid, is disposed in the plastic windshield(s). An oxalate powder is then placed between the vials and fills the balance of the space in plastic windshield(s). The windshield employed may either be opaque, transparent or translucent dependent upon the desired use. Thus, one requiring a tracer will employ a transparent or translucent windshield whereas one requiring only a site identification of the target area will employ an opaque windshield. It will be noted that the use of a rear windshield which may be threaded to fit body is an optional feature, which feature is typically used in conjunction with an optional aperture which allows chemlucent or chemiluminescent chemicals (or chemiluminescents) to flow into the rear windshield during activation of the projectile. It will be noted that vials break only on setback impact at which time the peroxide mixes with the oxalate ester to form a slurry which serves to mark the target area. The chemiluminescent materials produce light in all the visible spectrum and some of the IR spectrum. The XM1062 marker munition zinc body can be lethal to people and can do severe damage to light vehicles. Therefore, it is not applicable to marking people or light vehicles or targets. The velocity and range of the XM1062 projectile is the same as that of the M781.

Thus, it has been found that there exists a need for a long-range (greater than 70 meters) 40 mm non-lethal marking round with both visible and IR marking capabilities that can be fired from the M203 grenade launcher attached to the M16 rifle. The need is to mark people or light vehicles, with IR and visible light chemiluminescent chemicals, for several minutes to an hour without killing or seriously injuring the person or damaging the vehicle. This is needed by the military, homeland defense and police departments.

SUMMARY OF INVENTION

In accordance with the present invention, a non-lethal marker projectile that provides site identification capability of a target upon impact with the target is provided. This projectile includes a generally cylindrical rear base which is made of a resilient material and a front end (made of transparent, translucent or opaque, depending on the use, plastic or composite) extending longitudinally from the rear base. The front end includes an outer surface having a rear portion which is attached to the rear base and a nose portion serving as a windshield and which defines a space therein. The front end also includes a breakable container system located in the space which contains separated chemiluminescent reagents which when mixed produce light. The front end further includes a foam filler which surrounds the breakable container system and which fills the space. In addition, an optional plastic donut containing either chemlucent chemical (peroxide or oxalate liquid) or air to cushion impact with objects may be placed in the front end with the foam filler. With this projectile construction, the container system breaks on a setback impact that is exerted during firing and initial launch, causing the chemiluminescent reagents to mix and be absorbed into the foam filler such that upon impact of the projectile with the target, the foam filler marks the target with the mixed chemiluminescent reagents diffused therein.

In a preferred embodiment, the rear base is formed of rubber, plastic or composite, and the foam filler is formed of polyethylene or polypropylene foam or any other foam that is compatible with the chemlucent chemicals. Additionally, the rubber, plastic or composite may include a metal filler or glass fibers. Further, the rear base and/or front end may include a foam surface.

In another preferred embodiment, the rear base is provided with stress grooves so that the rear base shatters upon impact with the target. In addition, the projectile may include a metal insert located somewhere in the rear base. This allows the rear base to have a desired weight but utilizes the rubber, plastic or composite to cushion the impact of the metal insert when the projectile strikes a target.

In one preferred embodiment, the outer body surface includes a central portion connecting the rear portion and the nose portion, and wherein the outer surface is a separate member made of plastic. Then, the central and nose portion may be transparent or translucent such that visible light produced by the mixed chemiluminescent reagents is visible therethrough during flight of the projectile. If desired, the nose portion may include stress grooves so that the nose portion shatters upon impact with the target; and also if desired, the outer surface member may include an outermost foam surface.

In still another preferred embodiment, the foam filler forms the nose portion, and wherein a remainder of the outer surface is made of plastic and terminates adjacent the nose portion.

In yet another preferred embodiment, the breakable container system includes a plurality of breakable vessels. Preferably, the front end also includes a holder for the plurality of vessels. More preferably, the vessels are glass vials, and the foam filler includes a cavity in which the holder including the glass vials is securely located.

It is an advantage of the present invention that a long-range (greater than 70 meters) 40 mm non-lethal marking round is provided.

It is also an advantage of the present invention that, the non-lethal marking round provided can provide both visible and IR marking capabilities.

It is a further advantage of the present invention that the non-lethal marking round is capable of being fired from a standard M203 grenade launcher.

It is another advantage that the 40 mm non-lethal marker have the same general appearance and shape of the standard low velocity 40 mm cartridges.

Other features and advantages of the present invention are stated in or apparent from detailed descriptions of presently preferred embodiments of the invention found hereinbelow.

DETAILED DESCRIPTION

Figure 1:
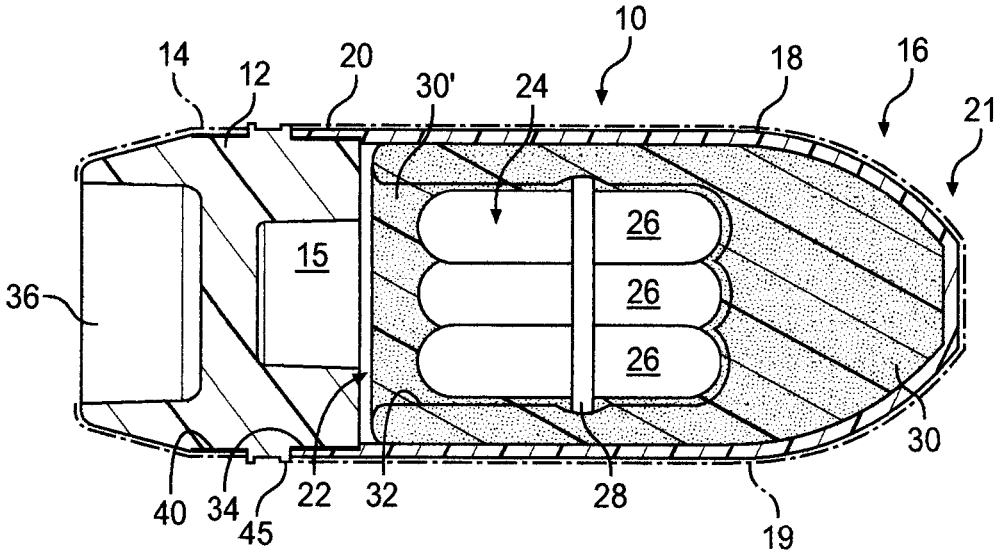
FIG. 1 is a cross-sectional view of a non-lethal marking projectile in accordance with a first embodiment of the present invention.
Figure 2:
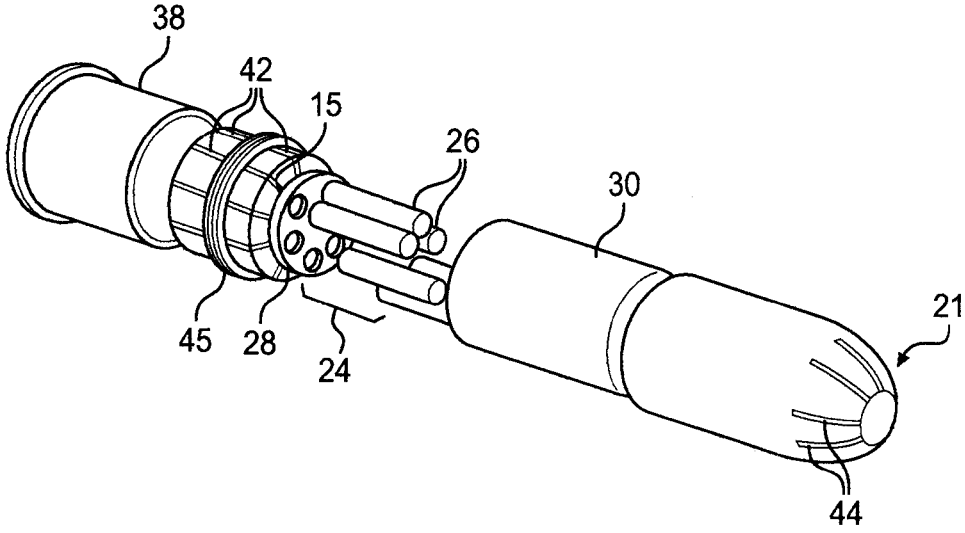
FIG. 2 is an exploded perspective view of the non-lethal marking projectile depicted in FIG. 1.

With reference now to the drawings in which like numerals represent like elements throughout the views, a first embodiment of a marker projectile 10 in accordance with the present invention is depicted in FIGS. 1 and 2. It will be appreciated that projectile 10 is designed to provide site identification capability of a target upon impact with the target. Projectile 10 includes a rubber or plastic or composite rear base 12 (such as nylon 12, or nylon 11, or Nylon 6/6 with an optional metal filler and/or optional glass fibers). If desired, an optional soft polypropylene foam surface 14 as shown schematically in FIG. 1 with a broken line may be provided on rear base 12 to provide additional protection to the target upon impact. While a forward cavity 15 has been depicted in base 12 which serves to reduce the weight of projectile 10, it will be appreciated that cavity 15 is sized in accordance with the weight and flight characteristics desired for projectile 10, so that cavity 15 can be of different sizes or not even present as desired. Likewise cavity 36 of rear base 12 can be of different sizes or not even present as desired in accordance with weight and flight characteristics desired for projectile 10.

Projectile 10 also includes a front end 16 which extends longitudinally from rear base 12. Front end 16 includes an outer surface which in this embodiment comprises a plastic (polyethylene or polypropylene) outer body 18 having a rear end 20 which is attached to rear base 12 and a windshield or nose portion 21. If desired and similar to foam surface 14, an optional soft polypropylene foam surface 19 as shown schematically in FIG. 1 with a broken line may be provided on outer body 18. It will be appreciated that outer body 18 defines a space 22 therein which is mostly filled as follows. Inside space 22 is a breakable container system 24. Breakable container system 24 contains separated chemiluminescent reagents which when mixed produce light (as used herein, light includes visible and/or IR wavelengths). In this preferred embodiment, breakable container system 24 includes a plurality of breakable vessels taking the preferred form of plastic or glass vials 26, though a single vessel with internally separated reagents could be provided. Breakable container system 24 also includes a plastic spider or holder 28 (made of polyethylene or polypropylene) as shown which is used to elastically retain, in the holes thereof, glass vials 26 together as a unit.

Front end 16 also includes a polyethylene or polypropylene foam filler 30 which is shaped with a rear opening cavity 32. To construct front end 16, glass vials 26 are first placed into the holes of the holder 28 to hold them in place, and outer body 18 is filled with foam filler 30. Glass vials 26 and spider 28 are then inserted inside of outer body 18 and pressed to a snug fit in cavity 32 of foam filler 30, at which time additional foam filler 30" (depicted with common cross-hatching with filler 30) to complete the enclosure of container system 24 can be injected or inserted in place. To complete construction of projectile 10, epoxy 34 is placed on the inside surface and the mating shoulder of rear end 20 of outer body 18 as shown in FIG. 1. Next, outer body 18 is pressed onto rear base 12, and any excess epoxy is wiped away. Projectile 10 is then held in a fixture or the like (not shown) until epoxy 34 has set in accordance with the epoxy directions. An adhesive 40 will be applied to base 12 for cartridge assembly, as shown in FIG. 2. The location of this adhesive is shown in FIG. 1 and is placed behind the obturator 45. Obturator 45 prevents propellant gases from blowing past the projectile 10 during gun launch and is a standard feature from the M781 and is needed on all 40 mm projectiles including the present non-lethal projectile 10.

As shown in FIG. 2, projectile 10 is received in a cartridge case 38, having a primer (not shown) pressed into a rear thereof. Standard primers and cartridge cases, such as plastic cartridge case 38 depicted in FIG. 2, from the M781 are conveniently used for the present invention. The primer is used to create propellant gases that propel projectile 10 through the grenade launcher and to the target. Thus, to produce a finished cartridge assembly, projectile 10 is removed from the holding fixture and an RTV (such as a standard RTV used for the M781) adhesive 40 is applied to projectile 10 in the location as shown in FIG. 1. Projectile 10 is pressed into the plastic cartridge case 38 until it reaches the obturator 45. Excessive adhesive 40 is wiped away, and the cartridge assembly is placed in a holding fixture until adhesive 40 is cured. The cartridge assembly is then ready for ballistic testing or shipping to a needed location.

In a preferred embodiment, rear base 12 is provided with stress grooves 42 (shown with an exaggerated size for clarity) so that rear base 12 shatters upon impact with the target to reduce the chance of injury or damage to the target. In addition, outer body 18 is also provided with stress grooves 44 (also shown with an exaggerated size for clarity) so that outer body 18 also shatters upon impact.

In operation, the assembled cartridge is chambered in the M203 grenade launcher or the like that is typically attached to the M16 rifle. The assembled cartridge is chambered in the same way as all other ammunition that is fired in the M203. The M203 chamber is closed and non-lethal projectile 10 is fired in the same manner as all other ammunition. When fired, the primer is set off and the gases ignited by the primer propel projectile 10 down the gun tube. The force exerted on projectile 10 as projectile 10 begins to move at firing is called a set-back force. This set-back force is designed to break glass vials 26 in projectile 10, so that the chemiluminescent chemicals previously separately contained in glass vials 26 mix and the mixed chemicals give off light. If the mixed chemicals are IR producing, then IR light is given off; while if the mixed chemicals are a visible formulation, then visible light is given off.

Fired projectile 10 continues down the gun tube and engages the rifling, which spins up the projectile to 3,600 rpm. The chemiluminescent chemicals thus become well mixed, and get absorbed onto and into foam filler 30 located inside outer body 18. With the M203, projectile 10 leaves the grenade launcher at a maximum velocity of 76 mps (250 fps). If outer body 18 is designed to be clear or a color that light may pass through, then the chemiluminescent light produced by the mixed chemicals provides a trace of the flight path of projectile 10 to the target. This means that the shooter or an observer can follow the flight of projectile 10 by eye. It will be appreciated that projectile 10 is spin stabilized all the way to the target.

Upon impact with the target, thin plastic windshield 21 shatters (with preferable stress grooves 44 causing it to easily shatter into non-lethal pieces with minimal force) and the foam filler 30, now acting much as a sponge saturated with the chemiluminescent chemical mixture, gently marks the person or target impacted. Foam filler/sponge 30 also takes up the impact force of the plastic composite rear base 12 so that the impacted person is not injured or the impacted target is not severely damaged. Plastic composite rear base 12 is also preferably designed with stress grooves 42 as noted above to cause it to shatter into non-lethal pieces with minimal force as well. After this impact, the target is now well marked for up to 2 hours—depending on the chemical formulation of the chemiluminescent mixture (for example, the prior art chemicals as described in U.S. Pat. No. 6,497,181 and the references cited therein). Projectile 10 is designed to fly up to 400 meters in a similar manner as the M781 to provide this marking capability.

Figure 3:
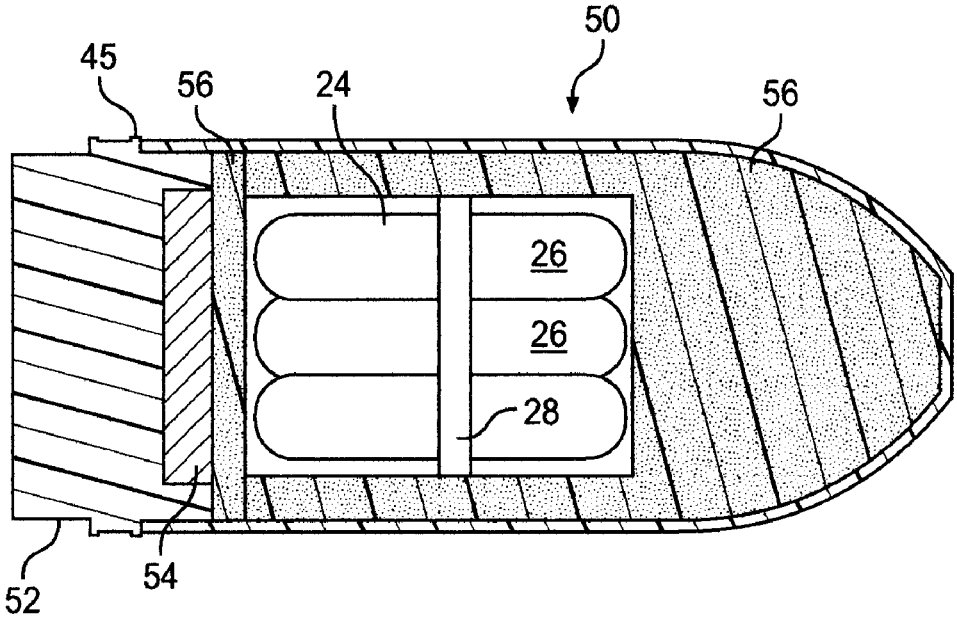
FIG. 3 is a cross-sectional view of a non-lethal marking projectile in accordance with a second embodiment of the present invention.

Depicted in FIG. 3 is an alternate 40 mm non-lethal chemiluminescent tracer/marker projectile 50 which is similar to projectile 10. Projectile 50 differs from projectile 10 primarily in the shape of The rubber, plastic or composite rear base 52 as shown. In addition, projectile 50 includes an optional metal insert 54 or the like located imbedded in the composite base 52. For visual purposes the metal insert is shown between a forward end of rear base 52 and a rearward end of foam filler 30. Insert 54 adds weight to projectile 50 for better/longer flight characteristics (and thus no equivalent to cavity 15 of projectile 10 is provided in rear base 52). Imbedding the metal insert 54 allows the rubber, plastic or composite base 52 to absorb the impact force with the target instead of the target being contacted by a hard metal. Further, foam filler 56 has a better defined cavity in which container system 24 is located such that mostly only holder 28 is resiliently held in contact with foam filler 56. In order to close the area behind container system 24, a piece of foam filler 56" (depicted with common cross-hatching with filler 56) is added behind foam filler 56 in this embodiment. All other features of projectile 50, such as assembly ballistics and tracer/marker features, are the same as projectile 10 and thus the same reference numerals as used with projectile 10 are used with projectile 50 as well with such similar features not being discussed further.

Figure 4:
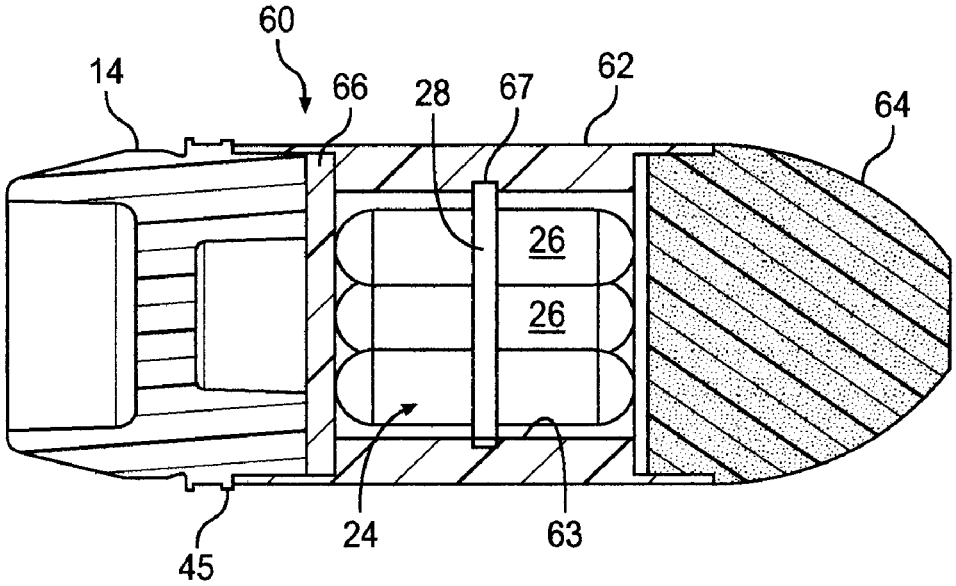
FIG. 4 is a cross-sectional view of a non-lethal marking projectile in accordance with a third embodiment of the present invention.

Depicted in FIG. 4 is a second alternate projectile 60 which differs primarily from projectile 10 by having plastic windshield 21 of outer body 18 replaced by a simple cylindrically shaped plastic outer body 62 with no nose portion. It will be appreciated that outer body 62 includes an expanded portion 63 which engages holder 28 to hold container system 24 in place. Instead of a plastic nose portion 21 formed integral with outer body 12, a similarly shaped nose portion 64 of foam filler 30 is provided, so that foam filler 30 thus now continues into a foam tip windshield as shown and outer body 62 and nose portion 64 constitute the outer surface of the front end of projectile 60. Foam filler 30 is placed around container system 24. Stress grooves 42 (not shown in FIG. 4) are also part of rear base 12 as shown in FIG. 2. A foam pad 66 is placed behind container system 24. As with projectile 50, all other features of projectile 60, such as assembly ballistics and tracer/marker features, are the same as projectile 10 and thus the same reference numerals as used with projectile 10 are used with projectile 60 as well with such similar features not being discussed further.

In this alternative embodiment, foam nose portion 64 contacts the person or target to be marked and provides an even softer impact. Projectile 60 is assembled by gluing foam pad 66 to rear base 12. Plastic outer body 62 is glued with epoxy to composite rear base 12. Glass vials 26 inside holder/spider 28 are then pressed into plastic outer body 62 until plastic spider 28 snaps into groove 67 of plastic outer body 62. Alternate foam filler 30 may be added between outer body 62 and glass or plastic vials 26. Foam nose 64 is pressed into outer body which contains epoxy (not shown) at contact points to ensure adhesion. After curing, projectile 60 is pressed into the cartridge case with the primer already inserted until the cartridge case 38 reaches the obturator 45 as previously described. This alternate cartridge design is now assembled. The ballistics projectile 60 of this alternate embodiment are the same as the other non-lethal projectile designs of projectiles 10 and 50.

Figure 5:
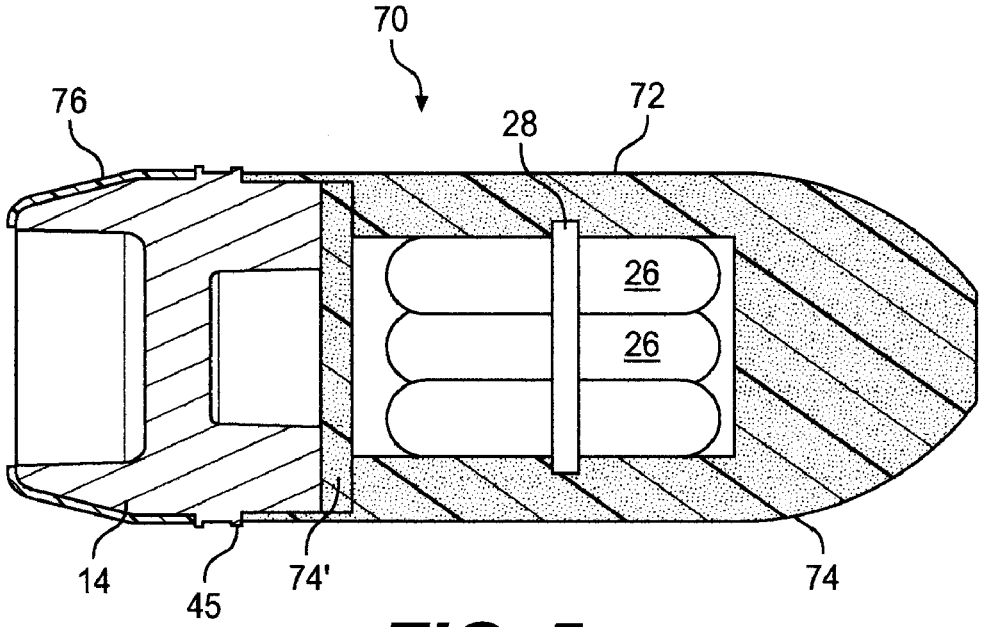
FIG. 5 is a cross-sectional view of a non-lethal marking projectile in accordance with a fourth embodiment of the present invention.

Depicted in FIG. 5 is a third alternate projectile 70 which differs from projectile 60 by having outer surface 62 and nose portion 64 formed by a single body 72 formed of foam. With this embodiment, impact on the target is very soft. As with projectile 50, a piece of foam filler 74" (depicted with common cross-hatching with filler 74) is added behind foam filler 74. In this preferred embodiment, for even greater protection for the target, a foam surface 76 is also provided on the rear base, as well as optional stress grooves as described above.

Figure 6:
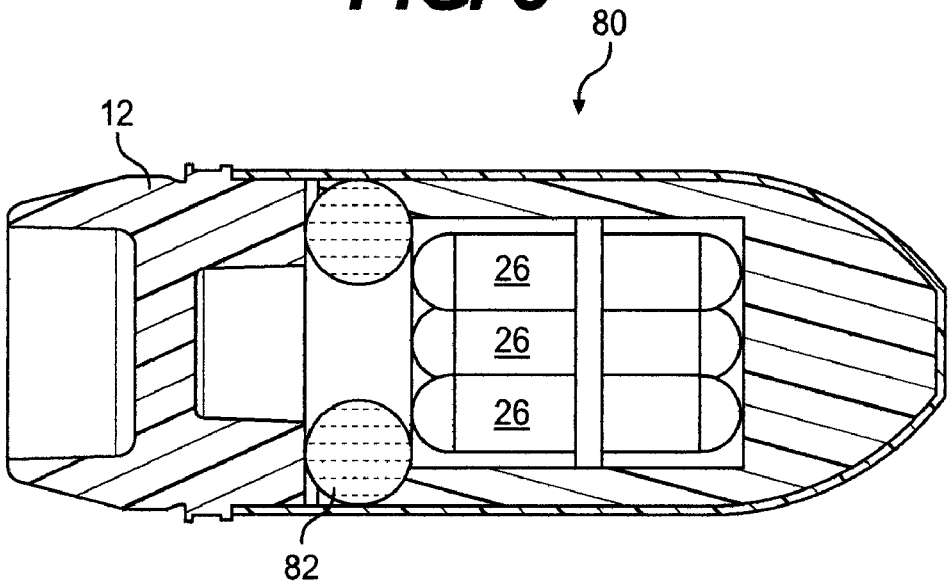
FIG. 6 is a cross-sectional view of a non-lethal marking projectile in accordance with a fifth embodiment of the present invention.

Depicted in FIG. 6 is a fourth alternative projectile 80 which differs from projectile 10 by having a donut shaped member 82 located behind glass vials 26 as shown. Member 82 forms an enclosed space which is filled with air or a liquid so that member 82 serves as an impact cushion for rear base 12 when the target is impacted to better insure that no damage is inflicted on the target by rear base 12.

As will be appreciated that by those of ordinary skill in the art, the mix of features of the various disclosed embodiments of the projectile of the present invention can be varied by adding from thereto or subtracting therefrom the features of other embodiments, to make additional embodiments with the scope and spirit of the invention.

Further, while the present invention has been described with respect to exemplary embodiments thereof, it will be understood by those of ordinary skill in the art that other variations and modifications can be effected within the scope and spirit of the invention.

The invention claimed is:

1. A non-lethal marker projectile that provides site identification capability of a target upon impact with the target, comprising:

a generally cylindrical rear base which is made of a resilient material; and a front end extending longitudinally from said, rear base, said front end including an outer surface having a rear portion which is attached to said rear base and a nose portion serving as a windshield, said outer surface defining a space therein, a breakable container system located in the space, said container system containing separated chemiluminescent reagents which when mixed produce light, and a foam filler which surrounds said breakable container system and which fills the space;

wherein the container system breaks on a setback impact that is exerted during firing and initial launch, causing the chemiluminescent reagents to mix and be absorbed into said foam filler such that upon impact of the projectile with the target, said foam filler marks the target with the mixed chemiluminescent reagents.

2. A non-lethal marker projectile as claimed in claim 1, wherein said outer surface includes a central portion connecting said rear portion and said nose portion, and wherein said outer surface is a separate member made of plastic.

3. A non-lethal marker projectile as claimed in claim 2, wherein said plastic nose portion is translucent such that visible light produced by the mixed chemiluminescent reagents is visible therethrough during flight of the projectile.

4. A non-lethal marker projectile that provides site identification capability of a target upon impact with the target, comprising:

a generally cylindrical rear base which is made of a resilient material and which includes stress grooves so that said rear base shatters upon impact with the target; and a front end extending longitudinally from said rear base, said front end including an outer surface having a rear portion which is attached to said rear base and a nose portion serving as a windshield, said outer surface defining a space therein, a plurality of breakable vials located in the space, said vials containing chemiluminescent reagents which when mixed produce light, a holder or said plurality of vials, and a foam filler including a central cavity in which said holder including said glass vials is securely located and which thus surrounds said breakable vials and which fills the space;

wherein the container system breaks on a setback impact that is exerted during firing and initial launch, causing the chemiluminescent reagents to mix and be absorbed into said foam filler such that upon impact of the projectile with the target, said foam filler marks the target with the mixed chemiluminescent reagents.

5. A non-lethal marker projectile as claimed in claim 4, wherein said nose portion is made of plastic and is provided with stress grooves so that said nose portion shatters upon impact with the target.

* * * * *